US011213078B2

(12) United States Patent
Mientjes et al.

(10) Patent No.: US 11,213,078 B2
(45) Date of Patent: Jan. 4, 2022

(54) SUPPORT GARMENT WITH LOCK DOWN SUPPORT

(71) Applicant: NIKE, Inc., Beaverton, OR (US)

(72) Inventors: Martine Mientjes, Portland, OR (US); Kevin C. Sze, Portland, OR (US); Rose Warnaar, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 15/175,717

(22) Filed: Jun. 7, 2016

(65) Prior Publication Data

US 2016/0360801 A1 Dec. 15, 2016

Related U.S. Application Data

(60) Provisional application No. 62/173,756, filed on Jun. 10, 2015.

(51) Int. Cl.
*A41C 3/00* (2006.01)
*A41D 13/00* (2006.01)
(Continued)

(52) U.S. Cl.
CPC ..... *A41C 3/00* (2013.01); *A41D 13/0017* (2013.01); *A41D 31/145* (2019.02); *A41D 31/185* (2019.02); *A41C 3/0085* (2013.01)

(58) Field of Classification Search
CPC ..... A41C 3/0085; A41C 3/10; A41C 3/00; A41D 13/0017
(Continued)

(56) References Cited

U.S. PATENT DOCUMENTS 2,033,065 A * 3/1936 Galligan ..... A41D 7/00 2/67
2,420,575 A * 5/1947 Treadwell ..... A41C 3/06 450/39
(Continued)

FOREIGN PATENT DOCUMENTS

AU 2011250729 A1 12/2011
CA 2922759 * 3/2015
(Continued)

OTHER PUBLICATIONS

Aesthetic Official, Womens Mesh Fishnet Striped See Through Sexy Lingerie Set Underwear Dress with T-back Plus Size, Aug. 12, 2014, http://www.aestheticofficial.com/product/womens-mesh-fishnet-striped-see-through-sexy-lingerie-set-underwear-dress-with-t-back-plus-size/, pp. 1-3 (Year: 2014).*
(Continued)

*Primary Examiner* — Alissa J Tompkins
*Assistant Examiner* — Brieanna Szafran
(74) *Attorney, Agent, or Firm* — Shook, Hardy & Bacon L.L.P.

(57) ABSTRACT

A support garment that provides upper and lower support for the breasts of a wearer through the use of alternating struts and openings to create a webbed configuration is provided. The first support area comprises an upper support portion made up of a first structural configuration comprising a plurality of alternating struts and openings. The upper support portion is located above breast cup portions of the support garment. The second support area comprises a lower support portion located below the breast cup portions. The lower support portion includes a second structural configuration comprising a plurality of alternating struts of openings.

15 Claims, 7 Drawing Sheets

(51) Int. Cl.
*A41D 31/14* (2019.01)
*A41D 31/18* (2019.01)

(58) Field of Classification Search
USPC ..... 450/1, 39
See application file for complete search history.

(56) References Cited

U.S. PATENT DOCUMENTS 2,429,680 A * 10/1947 Goddard ..... A41C 3/0007 450/39
2,457,369 A * 12/1948 Harman ..... A41C 3/00 450/1
2,535,864 A * 12/1950 Plehn ..... A41C 3/00 2/267
2,554,466 A * 5/1951 Lindo ..... A41C 3/00 450/92
2,659,085 A * 11/1953 Ericson ..... A41C 3/0014 450/39
2,686,312 A * 8/1954 Schmidt ..... A41C 3/142 2/258
2,797,415 A * 7/1957 Spanel ..... A41C 3/0014 450/39
2,891,548 A * 6/1959 Forti ..... A41C 3/00 450/86
2,971,514 A * 2/1961 Steinmetz ..... A41C 3/00 450/70
2,983,274 A * 5/1961 Plehn ..... A41C 3/0028 450/65
3,077,196 A * 2/1963 Paxton ..... A41C 3/00 450/39
3,093,139 A * 6/1963 Plehn ..... A41C 3/00 450/41
3,145,132 A * 8/1964 Seltzer ..... D03D 15/08 139/421
3,187,754 A * 6/1965 King ..... A41C 3/00 450/40
4,458,684 A 7/1984 Frankel
4,541,129 A * 9/1985 Murakami ..... A41B 9/06 2/113
D301,518 S * 6/1989 Schreiber-Miller ..... D2/708
6,165,045 A 12/2000 Miller
6,238,266 B1 5/2001 Vogt
6,287,168 B1 9/2001 Rabinowicz
6,306,006 B1 * 10/2001 Cheng ..... A41C 3/10 2/267
6,817,030 B2 * 11/2004 Desai ..... A41B 9/00 2/67
7,089,597 B2 8/2006 Horii et al.
7,435,155 B2 10/2008 Reinisch et al.
8,075,368 B2 12/2011 Puyaubreau et al.
8,128,457 B2 3/2012 Reinisch et al.
8,137,155 B2 * 3/2012 Horii ..... A41C 3/005 450/59
8,257,138 B2 9/2012 Smith
8,337,275 B2 12/2012 Martins-Crawbuck et al.
8,439,721 B2 5/2013 Sokolowski et al.
8,465,341 B2 6/2013 Shashy
8,523,629 B2 9/2013 Pundyk
8,549,763 B2 10/2013 Krawchuk
8,550,871 B1 * 10/2013 Baratta ..... A41C 3/0028 450/1
8,690,634 B2 4/2014 Heath et al.
8,690,814 B2 4/2014 Thompson
2005/0060792 A1 3/2005 Desai
2006/0183852 A1 8/2006 Liu et al.
2009/0117824 A1 * 5/2009 Jian ..... A41C 3/14 450/38
2010/0041313 A1 * 2/2010 Castellano ..... A41C 3/144 450/39
2010/0093258 A1 4/2010 Glenn et al.
2013/0017760 A1 * 1/2013 Kadium ..... A41C 3/148 450/30
2013/0084777 A1 4/2013 Starr
2013/0225045 A1 8/2013 Dandapure et al.
2013/0303050 A1 * 11/2013 Jackson ..... A41C 3/00 450/38
2015/0111466 A1 * 4/2015 Martinet ..... A41C 3/065 450/41
2016/0286879 A1 10/2016 Farmer et al.

FOREIGN PATENT DOCUMENTS

EP 1275313 A2 1/2003
FR 2864429 A1 7/2005
GB 618995 A 3/1949
GB 2265077 A 9/1993
JP H10292209 A 11/1998
WO 2012026831 A1 3/2012
WO 2013056302 A1 4/2013

OTHER PUBLICATIONS

She Wore It, Jasmin Walia's Topshop Black Sheer Fishnet Mesh Airtex & Solid Jersey Panel Sleevelss Bodycon Mini Dress, Jul. 22, 2014, http://sheworeitsheworeit.blogspot.com/2014/07/jasmin-walias-topshop-black-sheer.html, pp. 1-3 (Year: 2014).*
"How Products Are Made; vol. 6; Polyurethane"; madehow.com, 1 page. Accessed Sep. 25, 2014 http://www.madehow.com/Volume-6/Polyurethane.html.
"TPU Thermoplastic Polyurethane Bra Straps Material"; tputwss.en.alibaba.com Accessed Sep. 25, 2014 http://tpu-twss.en.alibaba.com/product/1719728626-209826789/TPU_Thermoplastic_Polyurethane_Bra_Straps_Material.html.
"Bonded laser-cut cotton-poplin bra top"; net-a-porter.com Accessed Sep. 25, 2014 http://www.net-a-porter.com/ca/en/product/433851.
International Search Report with Written Opinion dated Aug. 22, 2016 in International Application No. PCT/US2016/036344, 13 pages.
International Preliminary Report on Patentability dated Dec. 21, 2017 in International Patent Application No. PCT/US2016/036344, 8 pages.
Communication pursuant to Article 94(3) EPC dated Nov. 2, 2018 in European Patent Application No. 16730187.8, 4 pages.
Office Action received for Canadian Patent Application No. 2,987,279, dated May 17, 2021, 5 pages.
Communication under Rule 71(3) dated Jun. 5, 2019 in European Patent Application No. 16730187.8, 7 pages.

* cited by examiner

SUPPORT GARMENT WITH LOCK DOWN SUPPORT

CROSS-REFERENCE TO RELATED APPLICATIONS

This application, assigned U.S. application Ser. No. 15/175,717, filed Jun. 7, 2016, and entitled "Support Garment with Lock Down Support" claims priority to U.S. Prov. App. No. 62/173,756, filed Jun. 10, 2015, and entitled "Bra with Lock Down Support." The entirety of the aforementioned application is incorporated by reference herein.

BACKGROUND

Conventional support garments, especially sport bras, typically provide support by using materials or fabrics that compress the entire chest area. Support garments may also provide support through the use of underwires made of metals or hard plastics.

BRIEF DESCRIPTION OF THE DRAWINGS

Examples of the present invention are described in detail below with reference to the attached drawing figures, wherein.

DETAILED DESCRIPTION

Figure 1:
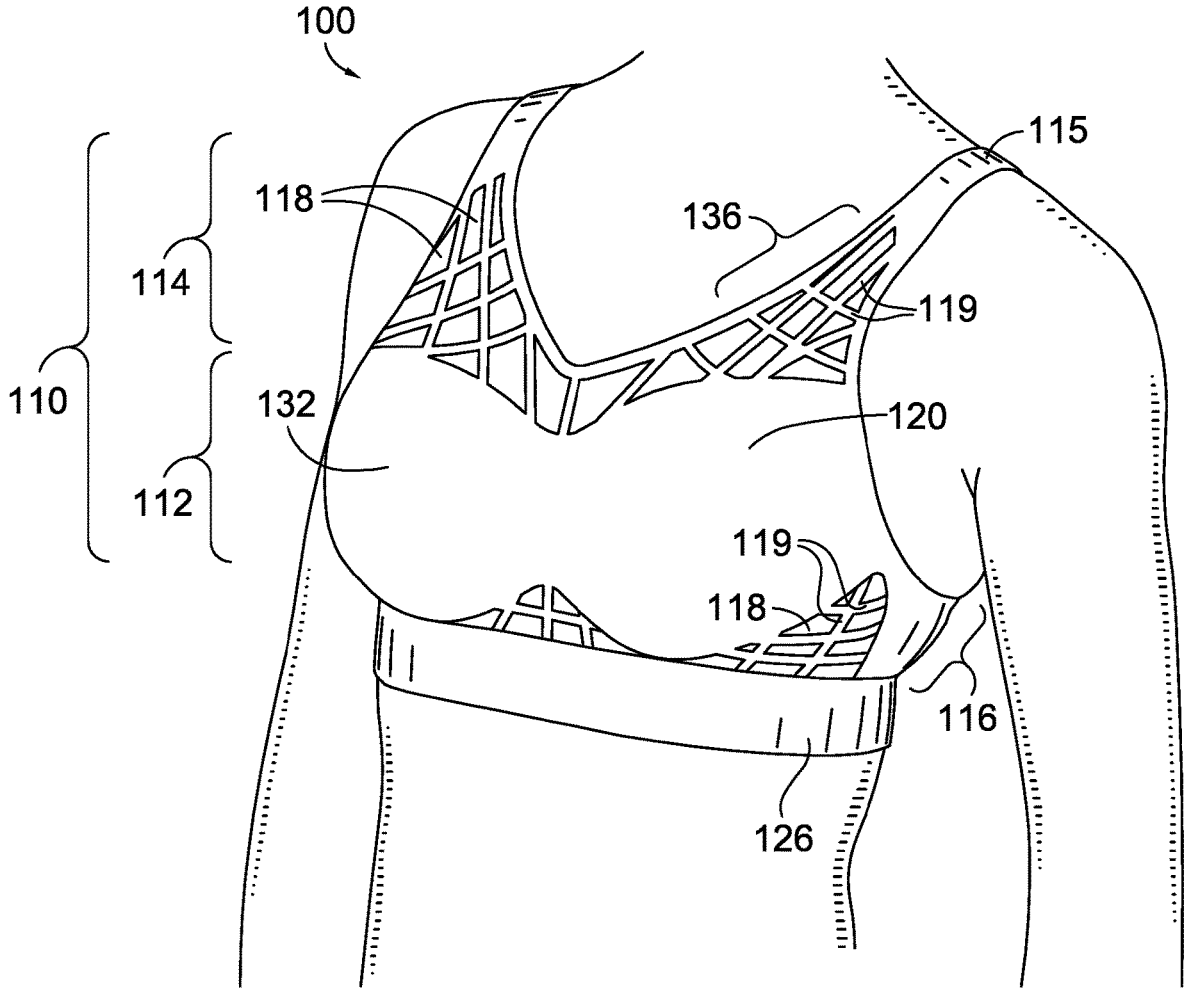
FIG. 1 illustrates a front perspective view of an exemplary support garment in the form of a bra having lock down support in accordance with an aspect herein.

The subject matter of the present invention is described with specificity herein to meet statutory requirements. However, the description itself is not intended to limit the scope of this disclosure. Rather, the inventors have contemplated that the disclosed or claimed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

At a high level, aspects herein are directed toward a support garment, such as a bra, that provides support through the use of engineered strut areas and lock down areas of a first layer of material. The support garment may comprise at least a first support area comprising an upper support portion made up of a first structural configuration comprising a plurality of openings made through the first layer of material and a second support area comprising a lower support portion made up of a second structural configuration comprising a plurality of openings made through the first layer of material.

In exemplary aspects, to provide support to, for example, the under portions and/or the lateral/medial portions of a wearer's breasts when the support garment is worn, the lower support portion is located under a breast cup area of the support garment such that it extends generally from a lateral side of the breast cup, down towards a lower margin of the breast cup, and up to a medial side of the breast cup. The upper support portion may provide lock down support to the wearer's breast when the support garment is worn and is located above the breast cups such that it extends generally from a lateral side of the breast cup, towards the upper margin of the breast cup and to the shoulder straps of the support garment when the support garment is in the as-worn configuration.

The openings in the first and second structural configurations may be defined and/or delineated by a plurality of struts formed between the openings. The struts may be straight or curved and may be positioned on the support garment to distribute tensioning forces in specific directions. In one aspect, alternating struts and openings create a webbed configuration. The webbed configuration in the upper support portion and lower support portion not only helps to distribute structural or tensioning forces in specific directions but also adds an element of flexibility and breathability to these areas. For instance, the openings may contribute to the breathability of the support garment.

The breast cup portion, upper support portion and lower support portion, moreover, may be adapted to provide a lock down area above and/or below the breast cup portion to provide support for a wearer's breasts when the support garment is worn. Lock down may be achieved in these areas by positioning a high modulus of elasticity material, such as a thermoplastic polymer, adjacent to the first layer of material at the upper and/or lower support portions. As used throughout this disclosure, the term "lock down" may be defined as an area of material that exhibits substantially no stretch or give. In exemplary aspects, lock down support may be added to the support garment by applying a reinforcement material to the internal facing surface of the upper and/or lower support portions. As an example, the upper support portion includes alternating struts and openings to strategically distribute tensioning forces applied to the support when the garment is worn. The internal facing surface of the remaining material (i.e., the struts) of the upper support portion is reinforced by applying a high modulus of elasticity material such as thermoplastic polyurethane (TPU), to the material. By providing reinforcement to the upper support portion, the wearer's breasts are provided with additional support beyond that provided by, for instance, a shoulder strap. In exemplary aspects, the reinforcement material may vary in elasticity to provide gradient support in the lock down area. Similarly, the lower support portion may be reinforced by applying a high modulus of elasticity material to this area of the support garment to provide additional support to the under portions of a wearer's breasts when the support garment is worn.

Having the breast cups with support and lock down portions (upper support and lower support portions) integrated into, for instance, a single layer of material provides several advantages. For instance, support can be localized to those areas that need more support instead of compressing the entire chest area which may be uncomfortable for the wearer and restrict movement. Moreover, providing support as described eliminates the need for underwires which may cause discomfort by pressing uncomfortably into the wearer's flesh. Integrating the support into a single layer of material also helps to make the support garment lightweight, less bulky and helps to provide a smoother, more aesthetic appearance. Further, the openings in the upper and lower support portions help to make the support garment more breathable and flexible. Additionally, integrating the support and lock down areas and bra cup portions into a single layer of material provides easier and simpler construction and manufacture.

Accordingly, aspects herein are directed to a support garment comprising at least a first layer of material having a first surface and a second surface opposite the first surface, where the first layer of material forms at least a breast cup portion, an upper support portion positioned superior to the breast cup portion when the support garment is worn, and a lower support portion positioned inferior to the breast cup portion when the support garment is worn. The upper support portion comprises a first structural configuration comprising a first plurality of openings in the first layer of material, and the lower support portion comprises a second structural configuration comprising a second plurality of openings in the first layer of material.

In another aspect, aspects herein are directed to a bra comprising at least a first layer of material having a first surface and a second surface opposite the first surface, where the first layer of material forms at least a front portion adapted to cover a wearer's breasts and at least a portion of the wearer's torso when the bra is in an as-worn configuration. The front portion comprises a pair of breast cup portions, and at least one upper support portion located superior to the pair of breast cup portions comprising a first structural configuration comprising a first plurality of openings in the first layer of material.

In yet another aspect, a support garment made by the following process is provided. The process comprises the steps of preparing a first layer of a material to form at least breast cup portions, an upper support portion positioned superior to the breast cup portions, and a lower support portion positioned inferior to the breast cup portions, where the first layer of material has a first surface and a second surface opposite the first surface. The process further comprises creating a first plurality of openings in the first layer of material at least at the upper support portion to create a first structural configuration, manipulating a reinforcement material to have a shape corresponding to the first structural configuration, and applying the reinforcement material to the second surface of the upper support portion.

FIG. 1 illustrates a front perspective view of a wearer wearing a support garment in the form of a bra 100 with breast cup portions 112, upper support portion 114 and lower support portion 116 in accordance with an aspect herein. While aspects discussed herein refer to bras, it will be understood that aspects are not limited to any particular style or type of support garment used to support breast tissue. For example, other support garments may include camisoles, swimwear or other garments with built-in support. Further, the depictions in the drawings are for exemplary purposes only and are in no way meant to limit the scope of the present invention. For instance, although the bra 100 is shown as a pull-over sport bra, the bra 100 may comprise more traditional style bras that include separate breast cups, front closures, back closures, removable shoulder straps, and the like.

The bra 100 comprises a front portion 110 including breast cup portions 112, upper support portion 114 and lower support portion 116. The bra 100 also comprises shoulder straps 115 adapted to extend over a wearer's shoulders when the bra 100 is worn, an under band 126 located under the breast cup portions 112 and adapted to encircle a torso area of the wearer when the bra 100 is worn, and a back portion 124 (shown in FIG. 2). The shoulder straps 115 may have a number of different configurations such as racerback, convertible, standard, and the like. The back portion 124 may be connected to the front portion 110 in part through the shoulder straps 115. As well, the bra 100 may have a front closure, a back closure, or the bra 100 may be donned and doffed by pulling the bra 100 over the wearer's head.

The front portion 110 of the bra 100 is the portion of the bra 100 that covers a portion of the torso of the wearer including the wearer's breasts when the bra 100 is worn. More specifically, the breast cup portions 112 are adapted to cover the wearer's breasts when the bra 100 is worn. More specifically, the breast cup portions 112 include a first breast cup area 113 and a second breast cup area 115 configured to cover a respective breast of a wearer. The breast cup portions 112 continuously extend from a first armhole edge 117 on a lateral side of the first breast cup area 113 to a second armhole edge 121 on a lateral side of the second breast cup area 115. The breast cup portions 112 may be unstructured or they may be structured or constructed such that they conform generally to the shape of the wearer's breasts (i.e., molded cups). In one example, the breast cup portions 112 and/or other portions of the bra 100 may be lined with an optional inner second layer or internal facing layer (not shown) that comes in contact with the wearer's skin when the bra 100 is worn, and/or an optional external shell layer positioned on an external facing surface 120 of the bra 100 when the bra 100 is worn. In another example, the front portion 110 may comprise a single layer of material 132 having an external facing surface 120 that faces the external environment when the bra 100 is worn and an inner-facing surface (not shown) that faces the wearer's skin when the bra 100 is worn. In this example, the breast cup portions 112 comprise a continuous expanse of the single layer of material 132 that extends continuously from the first armhole edge 117 to the second armhole edge 121 and further extends continuously between the upper support portion 114 and the lower support portion 112. With further respect to this example, an entirety of the upper support portion 114 is spaced apart from an entirety of the lower support portion 116 by the breast cup portions 112. Any and all aspects, and any variation thereof, are contemplated as being within aspects herein.

Figure 2:
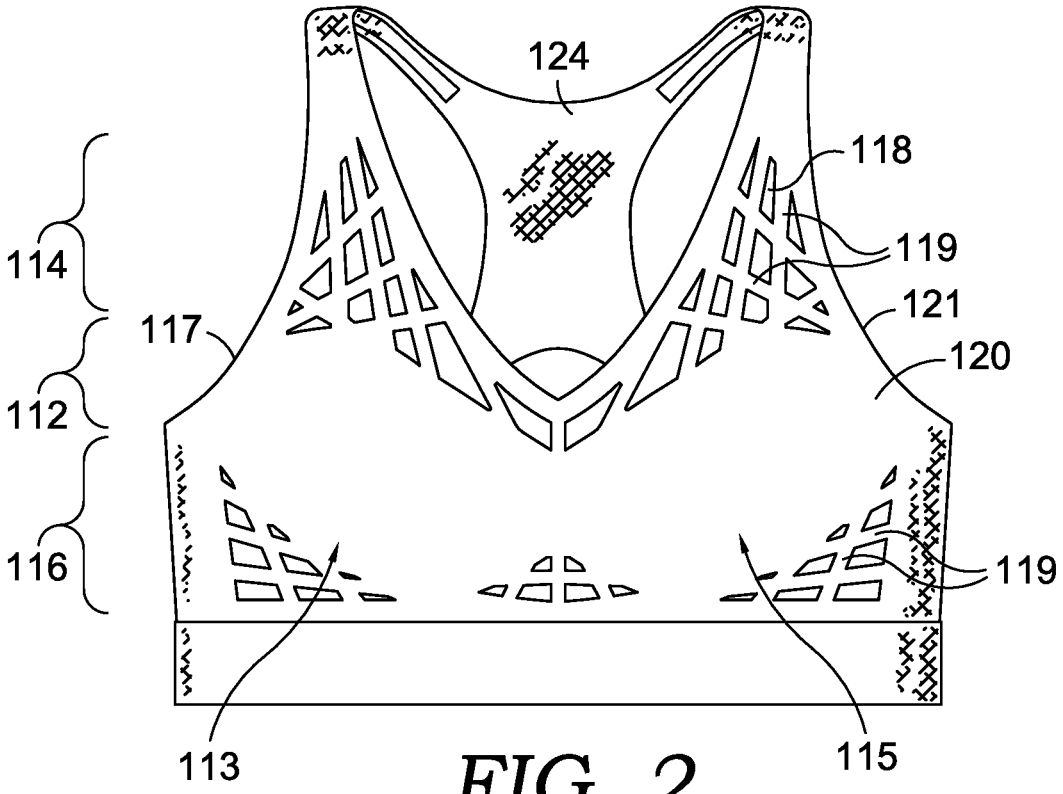
FIG. 2 illustrates a front view of the exemplary support garment of FIG. 1 in accordance with an aspect herein.

As shown in FIGS. 1 and 2, in one exemplary configuration, the breast cup portions 112, the upper support portion 114, and the lower support portion 116 may be integrally formed from the single layer of material 132 or together made up of the single layer of material 132. In another aspect, the breast cup portions 112, the upper support portion 114, and/or the lower support portion 116, may be made from separate pieces of material and attached or sewn together to create the single layer of material 132. In exemplary aspects, the single layer of material 132 may comprise a stretch woven fabric, a knit fabric, a non-woven fabric, and/or a composite construction. Moreover, the layer of material 132 may possess moisture-management characteristics (i.e., the ability of a material to move moisture from one surface to an opposite surface), breathability characteristics, fast-drying times, and the like.

In one aspect, a plurality of openings 118 are formed in the layer of material 132 such that they extend through the thickness of the layer of material 132 to form the upper support portion 114 and lower support portion 116. The openings 118 are defined and/or delineated by struts 119 where the struts 119 comprise portions of the layer of material 132 that remain after the openings 118 are formed. Thus, both the upper and lower support portions 114 and 116 may comprise the openings 118 and the struts 119. Areas of the layer of material 132, such as the breast cup portions 112, the upper support portion 114, and/or the lower support portion 116, may have different modulus of elasticity values due to, for example, reinforcement with high modulus materials such as TPU, the configuration of the struts 119, the configuration of the openings 118, and/or knitting or weaving these areas with yarns/fibers/filaments having a high modulus of elasticity. Modulus of elasticity may be defined as a measure of an object's resistance to being deformed elastically when a force is applied to it. Modulus values, as described herein, are measured at 40% stretch across the width of the bra 100 by ASTM D4964 and are expressed in pound-force (lbf) or Newton (N).

Figure 8:
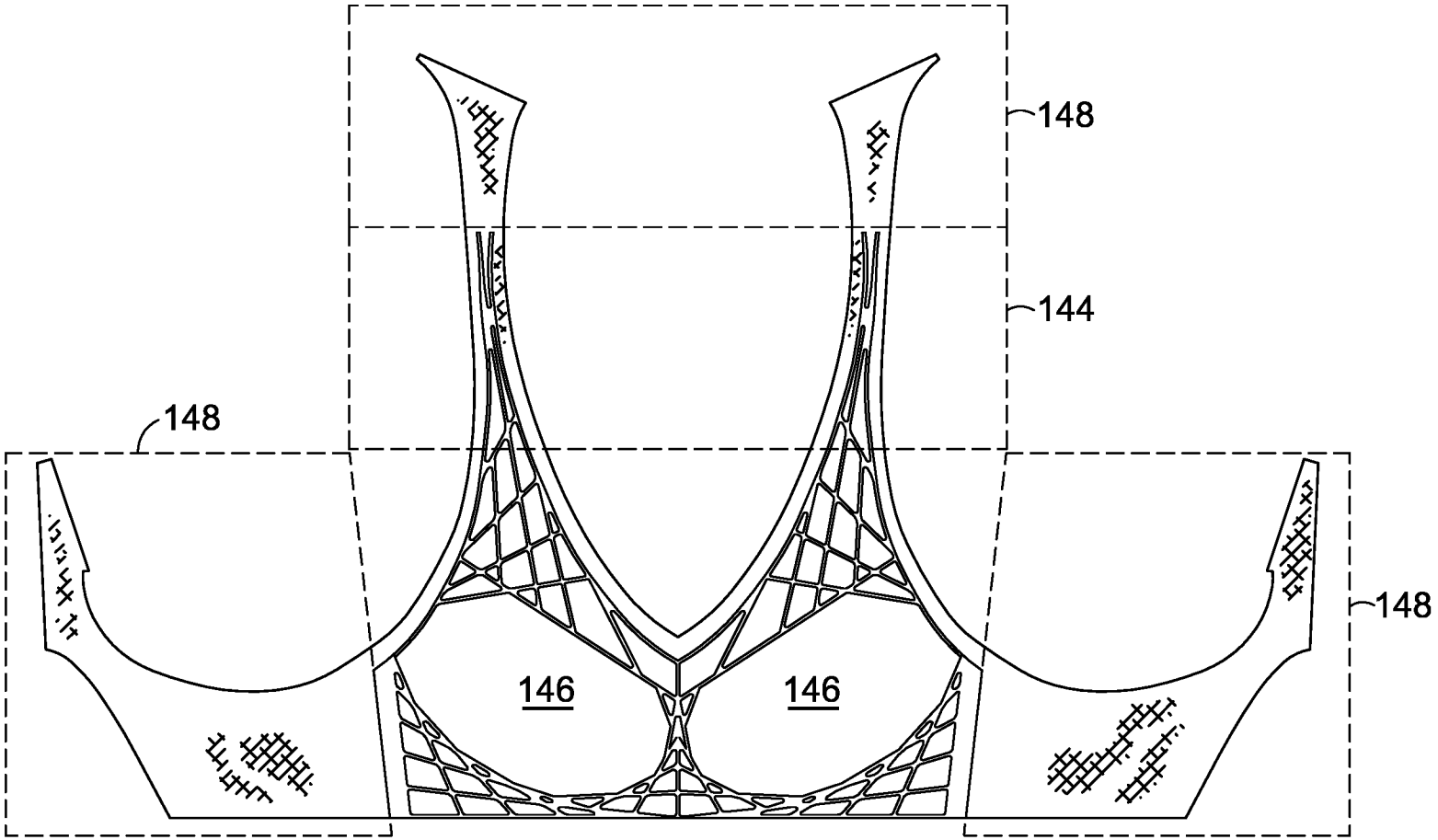
FIG. 8 illustrates a plan view of the exemplary support garment of FIG. 1 where the support garment is in a disassembled and laid-flat configuration and wherein different support zones are depicted.

In one aspect, the portions of the shoulder straps 115 that extend superior to the upper support portion 114 and the area at the back of the bra 100 may have a lower modulus of elasticity than, for example, the upper support portion 114, the lower support portion 116, and/or the breast cup portions 112. With reference to FIG. 8, which depicts the bra 100 in a disassembled and laid-flat configuration, the bra 100 may be thought of as comprising areas or zones 148 having a modulus between 7 N to 8 N at 40% stretch using standard modulus of elasticity tests and zones 144 and 146 that exhibit generally zero stretch or near zero stretch at 40% stretch. In exemplary aspects, the zones 148 may comprise portions of the shoulder straps 115 that are positioned adjacent to the back portion of the bra 100 when assembled. The zones 148 may also comprise, for example, the side regions of the bra 100. The zone 144 generally comprises at least a part of the upper support portion 114, where the zone 144 generally exhibits zero stretch at 40% stretch. The zone 146 generally comprises the breast cup portions 112, where the zone 146 generally exhibits near zero stretch at 40% stretch. Areas such the lower support portion 116 and areas of the upper support portion 114 located immediately superior to the breast cup portions 112 may exhibits stretch intermediate of the zones 148 and the zones 144 and 146. In other aspects, these areas may exhibit zero to near zero stretch at 40% stretch. In still other aspects, these areas may exhibit a gradient in stretch. Any and all aspects, and any variation thereof, are contemplated as being within aspects herein.

Referring again to FIGS. 1 and 2, as shown, the upper support portion 114 and the lower support portion 116 comprise a plurality of openings 118 in the layer of material 132. The openings 118 are formed from the layer of material 132 using methods of fabric cutting including manual techniques, machine cutting, laser cutting, water jet cutting, die-cutting, punching, and the like. It will be appreciated that the openings 118 in the upper and lower support portions 114 and 116 may be of any shape or size. In one aspect, once the openings 118 are formed, the plurality of struts 119 constructed from the single layer of material 132 remain for the upper and lower support portions 114 and 116.

Figure 6A:
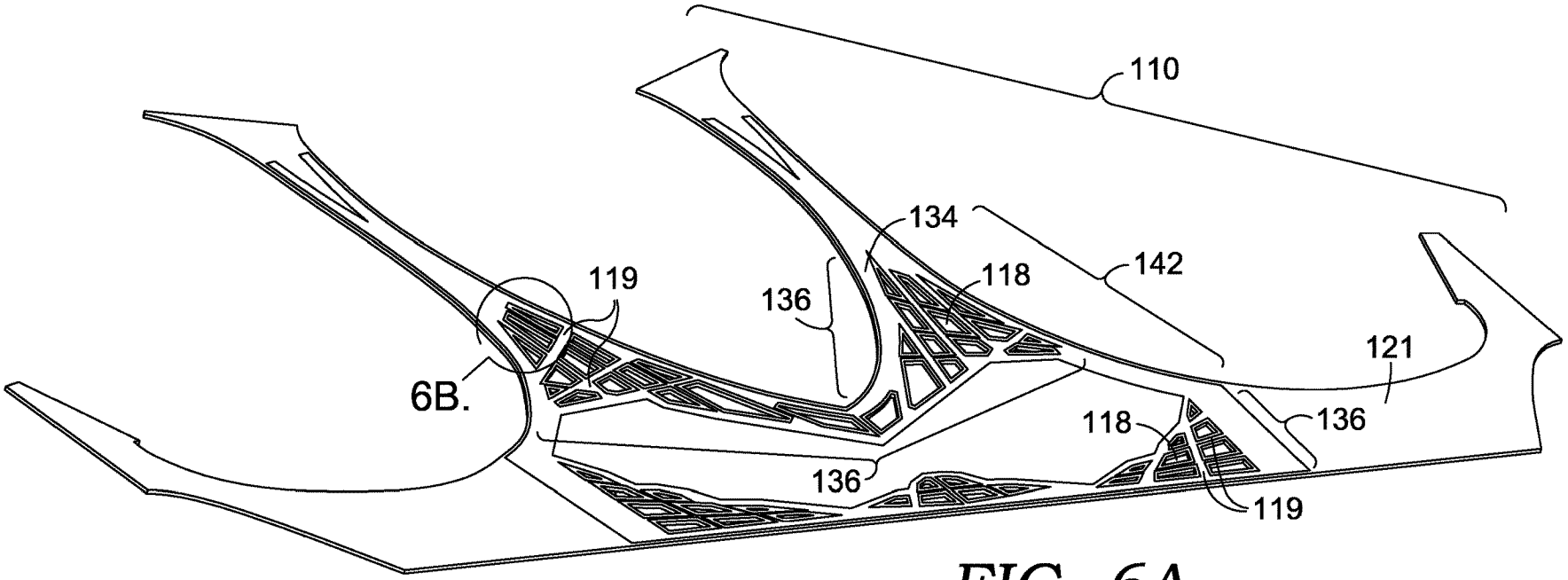
FIG. 6A illustrates a back or inner-facing view of the exemplary support garment of FIG. 1 where the support garment is in a disassembled and laid-flat configuration in accordance with an aspect herein.

As shown in FIG. 6A, which depicts an inner-facing view of the bra 100 is a disassembled and laid-flat configuration in accordance with aspects herein, the struts 119 combined with the openings 118 help to create a webbed configuration 136 for both the upper and lower support portions 114 and 116. The openings 118 in the webbed configuration 136 can be varied by size and location to provide the appropriate level of support for the breasts depending on the use of the bra 100 and breast size. It will be appreciated that the area of the openings 118 may be any size, and in one aspect may range from 2 $mm^2$ to 742 $mm^2$. The struts 119 may be comprised of crossing or intersecting lines. It will be appreciated that the struts 119 may be any variety of shapes and may be straight or curved. It will be appreciated that the struts 119 may be any size, and in one embodiment may range from 2 mm to 6 mm wide. It will be appreciated that the struts 119 formed from the layer of material 132 will typically be wider than the reinforcement material 134, described in more detail below. The length of the struts 119 may be any variety of lengths, and in one embodiment are between 20 mm to 275 mm in length.

The location of the struts 119 and the openings 118 may be engineered to effectively distribute tensioning forces applied to the bra 100 when worn. For instance, a tensioning force is generally applied to the shoulder straps 115 of the bra 100 when worn. Moreover, this tensioning force is generally oriented along the longitudinal axis of the shoulder strap 115 (i.e., in a vertical direction). Vertically aligned struts in the upper support portion 114 as shown in FIG. 1 may help to distribute this tensioning force and improve wearer comfort. In another example, a tensioning force is generally applied to the lower support portion 116 of the bra 100 when worn. This tensioning force is generally oriented circumferentially around the wearer's torso in a generally horizontal direction. Horizontally oriented struts in the lower support portion 116 as shown in FIG. 1 may help to counteract or distribute this tensioning force. Moreover, the webbed configuration associated with the upper support portion 114 and the lower support portion 116 not only helps to distribute tensioning forces but also decreases bra weight, increases breathability and flexibility, and adds an aesthetic appeal to these areas.

Figure 6B:
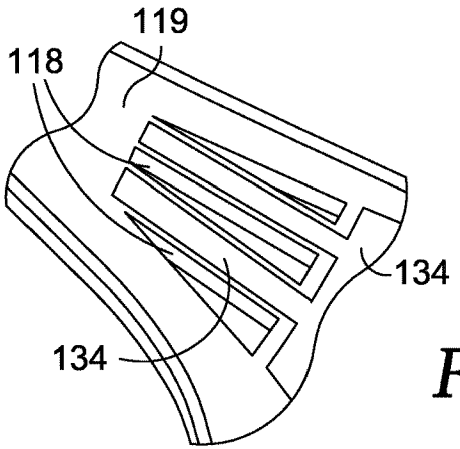
FIG. 6B illustrates a close-up view taken from the area indicated on FIG. 6A in accordance with an aspect herein.

With continued reference to FIG. 6A, a reinforcement material 134 on a second surface 121 of the remaining material (struts 119) of the upper support portion 114 is depicted and can provide a gradient level of support for front portion 110 of the bra 100. A close-up view of the reinforcement material 134 is shown in FIG. 6B. As depicted in FIG. 6B, the reinforcement material 134 is positioned adjacent to the struts 119 and has a shape that generally corresponds to the shape of the webbed configuration 136 of the upper support portion 114. In exemplary aspects, and with respect to a particular strut 119, the reinforcement material 134 may be the same width as the strut 119, or the reinforcement material 134 may be narrower than the strut 119. Any and all aspects, and any variation thereof, are contemplated as being within aspects herein.

The reinforcement material 134 may provide support by stiffening the struts 119 in the upper support portion 114, and/or the lower support portion 116, to produce lock down or near lock down in these areas. In one exemplary aspect, the reinforcement material 134 may be used in just the upper support portion 114 as lock down in this area may be important for supporting the weight of the wearer's breasts. The reinforcement material 134 may comprise a high modulus material such as thermoplastic polyurethane (TPU), silicone, polyurethane, and the like. In one aspect, the TPU used in at least 1 mm in thickness, providing a greater degree of lock down. It will be appreciated that the reinforcement material may, in some aspects, be 1 mm to 2 mm thick.

The reinforcement material 134 may provide greater design control and accommodate finer support structures using complex patterns or configurations. The pattern of the webbed configuration 136 may be used to distribute key structural forces in specific directions. The struts 119 and openings 118 can be placed to distribute force and provide support and flexibility.

In some aspects, the reinforcement material 134 may be modulated to fine-tune or customize support. For example, the reinforcement material 134 may be modulated depending on breast size, desired level of support, or user-specific sizing information and/or chest mapping (e.g., topographical data from a body scan or motion data). In one aspect the thickness of the reinforcement material 134 may remain the same while the width of the reinforcement material 134 may vary to increase or decrease elasticity or lock down in specific regions of the upper support portion 114 and/or the lower support portion 116. For example, the width of the reinforcement material 134 may decrease/taper in regions of the webbed configuration 136 that approach the breast cup portions 112. Such an approach may make the bra easier to doff and don, for example. In another example, the width of the reinforcement material 134 may remain constant and the thickness may vary to increase or decrease elasticity or lock down in specific regions of the upper support portion 114 and/or the lower support portion 116. For instance, the thickness of the reinforcement material 134 may decrease/taper in regions of the webbed configuration 136 that approach the breast cup portions 112. In yet another exemplary aspect, both the thickness and the width of the reinforcement material 134 may be adjusted to fine tune the modulus of elasticity in certain areas of the upper support portion 114 and/or the lower support portion 116.

In yet another example, the reinforcement material 134 may be modulated based on breast size. For example, for smaller sizes, less support may be needed and thus the width and/or thickness of the reinforcement material 134 may be decreased or omitted from select struts 119 in the webbed configuration 136. In contrast, for larger sizes or where a greater amount of support may be desired, the width and/or thickness of the reinforcement material 134 may be increased and any gradients in the reinforcement material 134 may be smaller or less pronounced. It will be appreciated that the reinforcement material 134 may designed as a single, whole piece of reinforcement material 134 that corresponds to the webbed configuration 136 of both the upper support portion 114 and the lower support portion 116. In another aspect, the reinforcement material 134 may be designed as a single, whole piece of reinforcement material 134 that corresponds to the webbed configuration 136 of the upper support portion 114. Further, the reinforcement material 134 may designed as a separate piece (separate from the reinforcement material 134 for upper support portion 114) that has a shape corresponding to the webbed configuration 136 of the lower support portion 116. Any and all aspects, and any variation thereof, are contemplated as being within aspects herein.

While FIG. 6A depicts the reinforcement material 134 on the upper support portion 114, it will be appreciated that the reinforcement material 134 may also be on the lower support portion 116 if additional support is desired. In that instance, the thickness and/or width of the reinforcement material 134 may be greater on the upper support portion 114 than the lower support portion 116.

Figure 3:
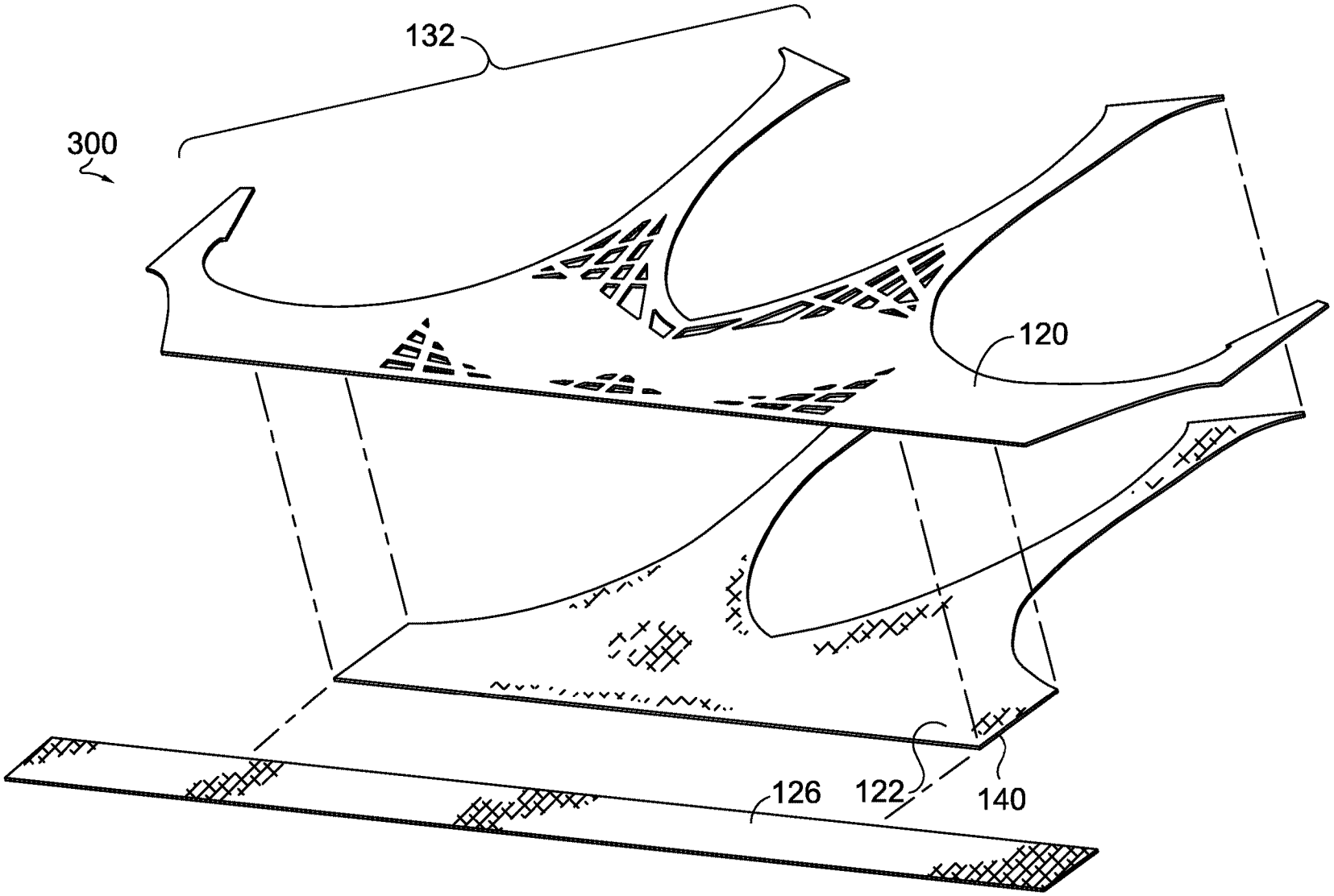
FIG. 3 illustrates an exploded view of an exemplary support garment having a first layer of material with upper and lower support portions and a second layer of material in accordance with an aspect herein.

Referring next to FIG. 3, an exemplary bra 300, which may comprise the bra 100, comprising two or more layers of material is shown. The layer of material 132 has an external facing surface 120 and a second opposite-facing surface (not shown). A second layer of material 122 may be optional in aspects and may be used for modesty purposes and/or to provide a color-contrast effect to the webbed portion of the bra 300. Under band 126 may, in exemplary aspects, may help to connect the layer of material 132 and the optional second layer of material 122 at a lower region of the bra 300. Alternatively, under band 126 may be separate from the two layers of material 132 and 122 and may be attached to second layer of material 122 and the layer of material 132 by any reasonable method for attaching material.

Figure 4:
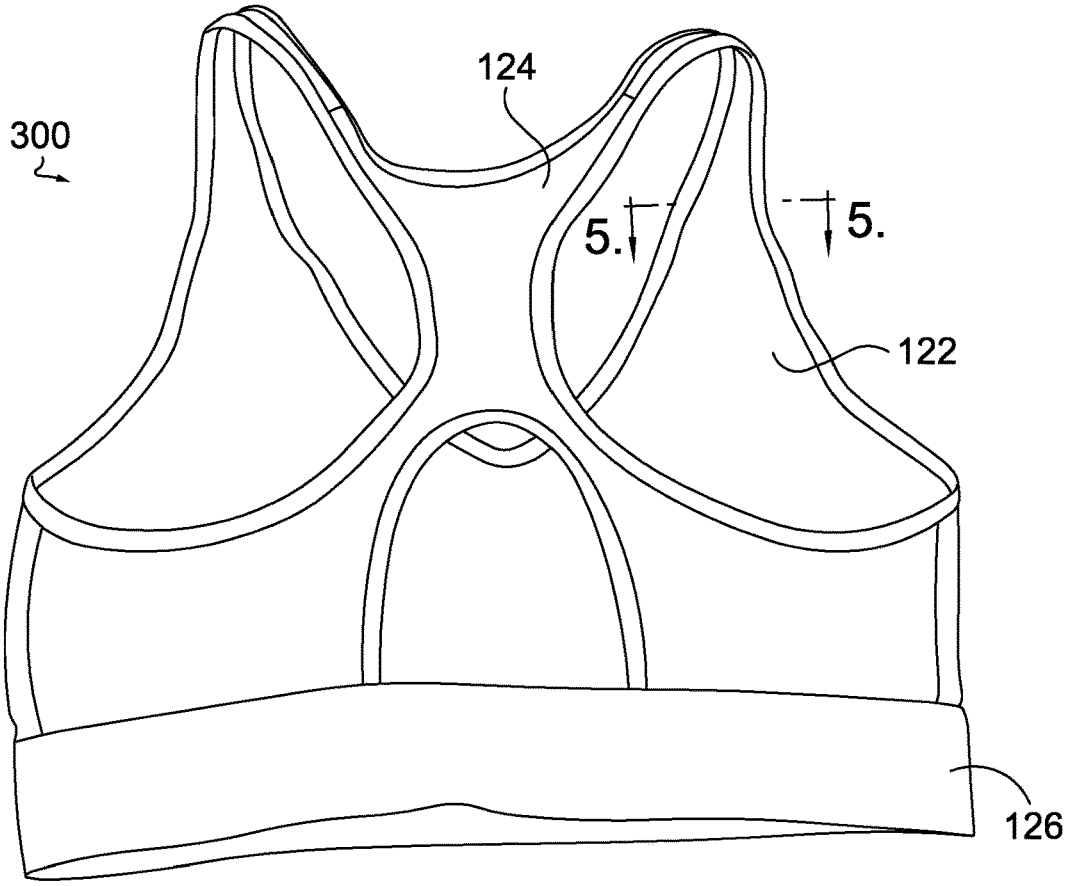
FIG. 4 illustrates a back view of an exemplary support garment having two layers of material in accordance with an aspect herein.
Figure 5:
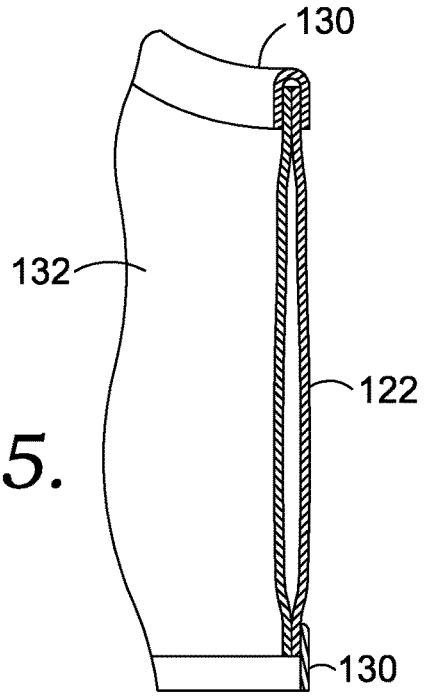
FIG. 5 illustrates a cross-sectional view of the exemplary support garment of FIG. 4 taken along cut line 5-5 and depicting the attachment of the two layers of material in accordance with an aspect herein.

With reference to FIGS. 4 and 5, the exemplary bra 300 with two or more layers of material is depicted in accordance with aspects herein. FIG. 4 depicts a back view of the bra 300. The single layer of material 132 and the second layer of material 122 are attached at perimeter edges 130 of the materials 122 and 132 as shown in FIG. 5. In other words, the breast cup portion 112, the upper support portion 114 and the lower support portion 116 of the layer of material 132 are not attached and/or are unaffixed to the second layer of material 122 except at the perimeter edges 130 such that the layer of material 132 is freely moveable with respect to the second layer of material 122 except at the perimeter edges 130. As such the breast cup portion 112, upper support portion 114, and lower support portion 116, can move freely of the second layer of material 122 providing more flexibility and stretch for the individual wearing the bra 300. It will be appreciated that the attachment of the layers of material 122 and 132 may be done in any variety of ways.

Figure 7:
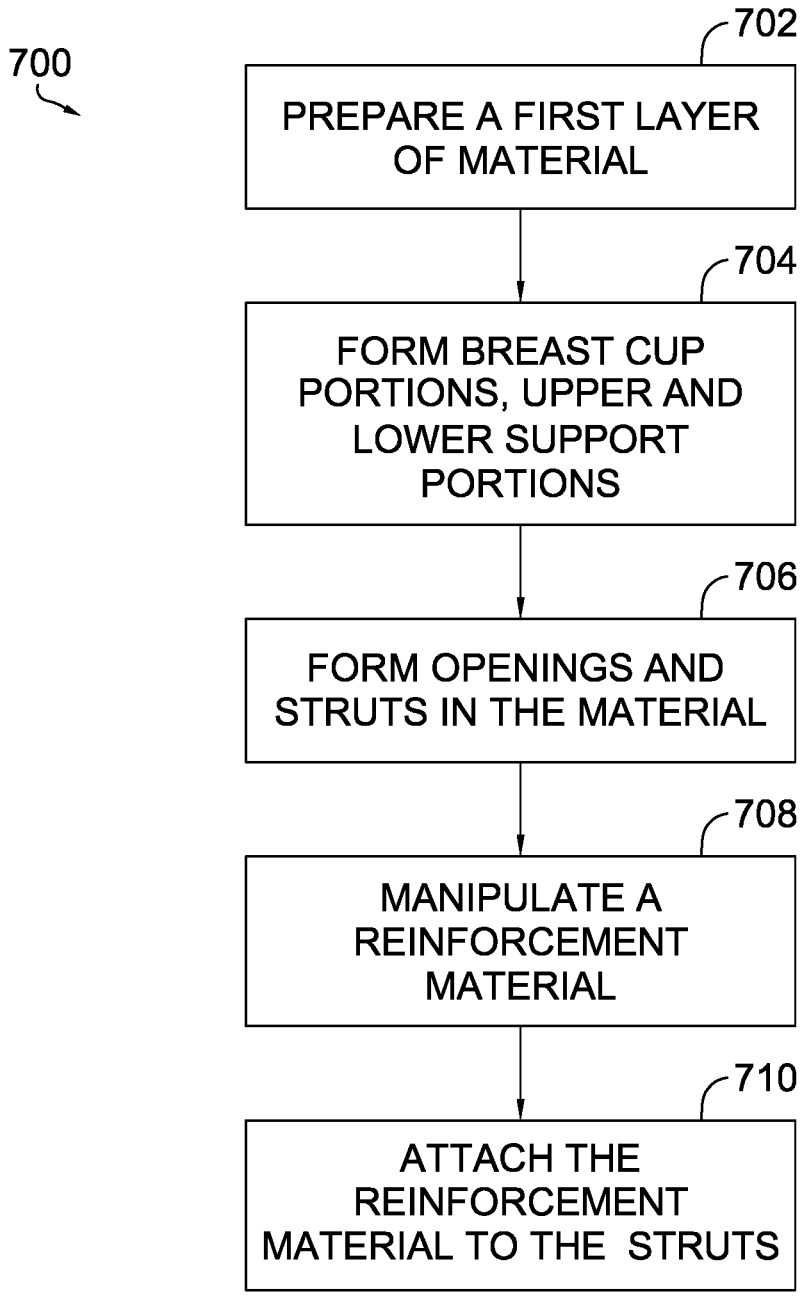
FIG. 7 illustrates a flow diagram of an exemplary method of manufacturing an exemplary support garment having lock down support in accordance with an aspect herein.

With reference to FIG. 7, an exemplary method 700 of making an exemplary support garment, such as the bra 100, as described herein is provided. A first layer of material, such as the layer of material 132 is provided at step 702. The first layer of material is manipulated (i.e., cut or incised) to form breast cup portions, and upper and lower support portions at step 704. A plurality of openings are formed in the first layer of material at the upper and lower support portions at step 706 leaving strut portions remaining. After preparation, the support garment comprises an external facing surface and an internal facing surface.

Reinforcement material (such as TPU) is manipulated (i.e., cut or incised) at step 708 to have a shape corresponding to the pattern of openings and struts of the first layer of material. It will be appreciated that in some instances the reinforcement material may not be cut for all of the corresponding struts on the first layer of material due to the need for a gradient level of support. The reinforcement material is placed over the corresponding pattern of struts on the first layer of material on the upper and/or lower support portions and heat pressed to bond the reinforcement material to the first layer of material at step 710. It will be appreciated that the reinforcement material may be cut as a single sheet or as multiple sheets to be placed on the first layer of material. In general, the reinforcement material is applied to the second surface (internal facing surface) of the first layer of material, although it is contemplated herein that the reinforcement material may also be applied to the first surface (external facing surface) of the first layer of material. It will be appreciated that the reinforcement material may be attached to the first layer of material in any variety of bonding manners including thermal bonding, mechanical, and/or chemical bonding.

When a second layer of material is used, the first layer of material and the second layer of material may be prepared by cutting and affixing the different layers to each other using affixing technologies such as stitching, adhesives, welding, bonding, and the like. In exemplary aspects, the second layer of material is affixed to the first layer of material at the perimeter edges of both layers of material. Additional ways of making a breast cup having support portions are contemplated herein.

Aspects of the present invention have been described with the intent to be illustrative rather than restrictive. Alternative aspects will become apparent to those skilled in the art that do not depart from its scope. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims. Not all steps listed in the various figures need be carried out in the specific order described.

What is claimed is:

1. A support garment comprising:

a front portion formed from a first layer of stretch woven material or knit material, the first layer having a first surface and a second surface opposite the first surface, the first layer forming at least: 1) a breast cup portion having a first breast cup area and a second breast cup area, each of the first breast cup area and the second breast cup area configured to cover a respective breast of a wearer, 2) an upper support portion positioned superior to the breast cup portion when the support garment is worn, and 3) a lower support portion positioned inferior to the breast cup portion when the support garment is worn, wherein an entirety of the upper support portion is spaced apart from an entirety of the lower support portion by the breast cup portion, and wherein the breast cup portion comprises a continuous expanse of the first layer extending continuously from a first armhole edge on a lateral side of the first breast cup area to a second armhole edge on a lateral side of the second breast cup area and extending continuously between the upper support portion and the lower support portion;

the upper support portion comprising a first structural configuration comprising a first plurality of openings in the first layer;

the lower support portion comprising a second structural configuration comprising a second plurality of openings in the first layer, the lower support portion extending from the lateral side of each of the first breast cup area and the second breast cup area, down toward a lower margin of each of the first breast cup area and the second breast cup area, and further extending to a location at least partially between the first breast cup area and the second breast cup area, the second plurality of openings also extending from the lateral side of each of the first breast cup area and the second breast cup area, down toward the lower margin of each of the first breast cup area and the second breast cup area, and further extending to the location at least partially between the first breast cup area and the second breast cup area, further comprising a thermoplastic polyurethane material affixed to the second surface of the first layer at the upper support portion, wherein the thermoplastic polyurethane material is absent from the breast cup portion; and an under band positioned under the lower support portion and configured to encircle a torso area of a wearer when the support garment is worn.

2. The support garment of claim 1, wherein the first surface is an external facing surface of the support garment.

3. The support garment of claim 2, wherein the second surface is an internal facing surface of the support garment.

4. The support garment of claim 3, wherein the upper support portion with the thermoplastic polyurethane material affixed thereto has zero stretch or near zero stretch at 40% stretch.

5. The support garment of claim 4, wherein the thermoplastic polyurethane material is bonded to the second surface of the upper support portion.

6. The support garment of claim 5, wherein the thermoplastic polyurethane material varies in elasticity to provide a gradient of elasticity in the upper support portion.

7. The support garment of claim 1, wherein the first plurality of openings are separated by a first plurality of struts formed by the first layer.

8. The support garment of claim 7, wherein the second plurality of openings are separated by a second plurality of struts formed by the first layer.

9. The support garment of claim 8, wherein the first plurality of struts and the first plurality of openings create a first webbed configuration.

10. The support garment of claim 9, wherein the second plurality of struts and the second plurality of openings created a second webbed configuration.

11. A bra comprising:

a front portion formed from a single layer of material that is either a stretch woven material or a knit material, the single layer of material having a first surface and a second surface opposite the first surface, wherein the first surface faces an environment external to the bra when the bra is in an as-worn configuration, and wherein the second opposite surface faces a skin surface of a torso portion of a wearer when the bra is in the as-worn configuration, the front portion comprising, a breast cup portion having a first breast cup area and a second breast cup area, each of the first breast cup area and the second breast cup area configured to cover a respective breast of a wearer, the breast cup portion comprising a continuous expanse of the single layer of material extending continuously from a first armhole edge on a lateral side of the first breast cup area to a second armhole edge on a lateral side of the second breast cup area, at least one upper support portion located superior to the breast cup portion, the upper support portion comprising a first structural configuration comprising a first plurality of openings in the single layer of material, and a lower support portion located inferior to the breast cup portion, the lower support portion comprising a second structural configuration comprising a second plurality of openings in the single layer of material a thermoplastic polyurethane material affixed to the second surface of the upper support portion, wherein the thermoplastic polyurethane material limits stretch in the upper support portion, wherein the thermoplastic polyurethane material is absent from the breast cup portion; and an under band positioned under the lower support portion and configured to encircle a torso area of a wearer when the bra is worn.

12. A support garment comprising:

a front portion formed from a single layer of material formed from a stretch woven material or a knit material and having an inner-facing surface and an outer-facing surface, the front portion comprising:

a breast cup portion comprising a first breast cup area and a second breast cup area, each of the first breast cup area and the second breast cup area configured to cover a respective breast of a wearer, the breast cup portion comprising a continuous expanse of the single layer of material extending continuously from a first armhole edge on a lateral side of the first breast cup area to a second armhole edge on a lateral side of the second breast cup area, an upper support portion located superior to the breast cup portion and comprising a first webbed configuration formed from a first plurality of linear struts that define a first plurality of variably sized openings having linear edges, a thermoplastic polyurethane material affixed to the inner-facing surface of the upper support portion, wherein the thermoplastic polyurethane material limits stretch in the upper support portion, and wherein the thermoplastic polyurethane material is absent from the breast cup portion, and a lower support portion located inferior to the breast cup portion and extending from the lateral side of each of the first breast cup area and the second breast cup area, down toward a lower margin of each of the first breast cup area and the second breast cup area, and further extending to a location at least partially between the first breast cup area and the second breast cup area, the lower support portion comprising a second webbed configuration formed from a second plurality of linear struts that define a second plurality of variably sized openings having linear edges, wherein the second plurality of variably sized openings also extends from the lateral side of each of the first breast cup area and the second breast cup area, down toward the lower margin of each of the first breast cup area and the second breast cup area, and further extending to the location at least partially between the first breast cup area and the second breast cup area;

a back portion connected to the front portion at first and second sides of the support garment;

a pair of shoulder straps that connect the front portion and the back portion and an under band positioned under the lower support portion and configured to encircle a torso area of a wearer when the support garment is worn.

13. The support garment of claim 12, wherein the upper support portion extends from the lateral side of each of the first breast cup area and the second breast cup area, up toward an upper margin of each of the first breast cup area and the second breast cup area, and further extends to a second location at least partially between the first breast cup area and the second breast cup area.

14. The support garment of claim 12, wherein each linear strut of the first plurality of linear struts has a length and a width, and wherein the length of the each linear strut of the first plurality of linear struts is vertically oriented on the support garment.

15. The support garment of claim 14, wherein each linear strut of the second plurality of linear struts has a length and a width, and wherein the length of the each linear strut of the second plurality of linear struts is horizontally oriented on the support garment.

* * * * *